US009464469B2

(12) United States Patent
Fraser

(10) Patent No.: US 9,464,469 B2
(45) Date of Patent: Oct. 11, 2016

(54) HINGE ASSEMBLY FOR LID OF CONTAINER

(71) Applicant: Keith T. Fraser, Annapolis, MD (US)

(72) Inventor: Keith T. Fraser, Annapolis, MD (US)

(73) Assignee: Keith Fraser, Annapolis, MD (US)

( * ) Notice: Subject to any disclaimer, the term of this patent is extended or adjusted under 35 U.S.C. 154(b) by 19 days.

(21) Appl. No.: 14/329,566

(22) Filed: Jul. 11, 2014

(65) Prior Publication Data

US 2015/0013108 A1 Jan. 15, 2015

Related U.S. Application Data

(60) Provisional application No. 61/845,028, filed on Jul. 11, 2013.

(51) Int. Cl.
*E05D 3/02* (2006.01)
*E05D 11/06* (2006.01)

(52) U.S. Cl.
CPC ..... *E05D 3/02* (2013.01); *E05D 11/06* (2013.01); *Y10T 16/558* (2015.01); *Y10T 16/5535* (2015.01)

(58) Field of Classification Search
CPC ..... Y10T 16/5535; Y10T 16/551; Y10T 16/557; Y10T 16/558; E05D 3/02; E05D 5/046; E05D 11/06; B65D 43/166; B65D 43/167; F25D 23/028
USPC ..... 16/381, 374, 386, 387; 312/326, 405; 220/832, 848
See application file for complete search history.

(56) References Cited

U.S. PATENT DOCUMENTS

| | | | | |
|---|---|---|---|---|
| 2,255,529 A * | 9/1941 | May | E05D 7/0018 | 16/240 |
| 3,962,750 A * | 6/1976 | Buss | E05D 3/02 | 16/381 |
| 4,696,412 A * | 9/1987 | McGowan | B65D 43/167 | 16/257 |
| 8,205,304 B2 * | 6/2012 | Le | E05D 11/081 | 16/340 |
| 2013/0069511 A1 * | 3/2013 | Westby | E05D 5/12 | 312/326 |

* cited by examiner

*Primary Examiner* — William Miller
(74) *Attorney, Agent, or Firm* — Berenato & White, LLC

(57) ABSTRACT

A hinge assembly for pivotally connecting a lid to a receptacle of a container, comprises a first hinge half including a convex edge portion, and a second hinge half pivotally connected to the first hinge half for pivotable movement between a flattened position and a folded position of the hinge assembly. The second hinge half includes a concave nesting depression nestably engaging the convex edge portion of the first hinge half in the folded position of the hinge assembly.

20 Claims, 12 Drawing Sheets

HINGE ASSEMBLY FOR LID OF CONTAINER

CROSS-REFERENCE TO RELATED APPLICATION

This application claims the benefit under 35 U.S.C. 119(e) of U.S. Provisional Patent Application Ser. No. 61/845,028 filed Jul. 11, 2013 by Fraser et al., which is hereby incorporated herein by reference in its entirety and to which priority is claimed.

BACKGROUND OF THE INVENTION

1. Field of the Invention

The present invention relates to hinge assemblies in general, and more particularly to a hinge assembly for pivotally connecting a lid to a receptacle of a container.

2. Description of the Related Art

Generally, insulated containers, such as coolers for cold drinks or the like, are well known in the art. Typical insulated containers include a box-like receptacle and a lid mounted thereon and pivotable between open and closed positions. The insulated containers further include hinge assemblies connecting the lid to the receptacle for pivotal movement between open and closed positions. Hinge assemblies are known for pivotally connecting the lid to receptacle of insulated containers. Hinge assemblies are described in, for example, U.S. Pat. Nos. 4,696,412 and 3,962,750.

While hinge assemblies for containers, including but not limited to those discussed above, have proven to be acceptable for typical applications and conditions, improvements that may enhance their performance and cost are possible.

BRIEF SUMMARY OF THE INVENTION

The present invention is directed to a hinge assembly for pivotally connecting a lid to a receptacle of a container.

The hinge assembly according to the present invention comprises a first hinge half including a convex edge portion, and a second hinge half pivotally connected to the first hinge half for pivotable movement between a flattened position and a folded position of the hinge assembly. The second hinge half includes a concave nesting depression nestably engaging the convex edge portion of the first hinge half in the folded position of the hinge assembly.

BRIEF DESCRIPTION OF THE DRAWINGS

The accompanying drawings are incorporated in and constitute a part of the specification. The drawings, together with the general description given above and the detailed description of the exemplary embodiments and methods given below, serve to explain the principles of the invention. In such drawings.

DETAILED DESCRIPTION OF EXEMPLARY EMBODIMENTS

Figure 1:
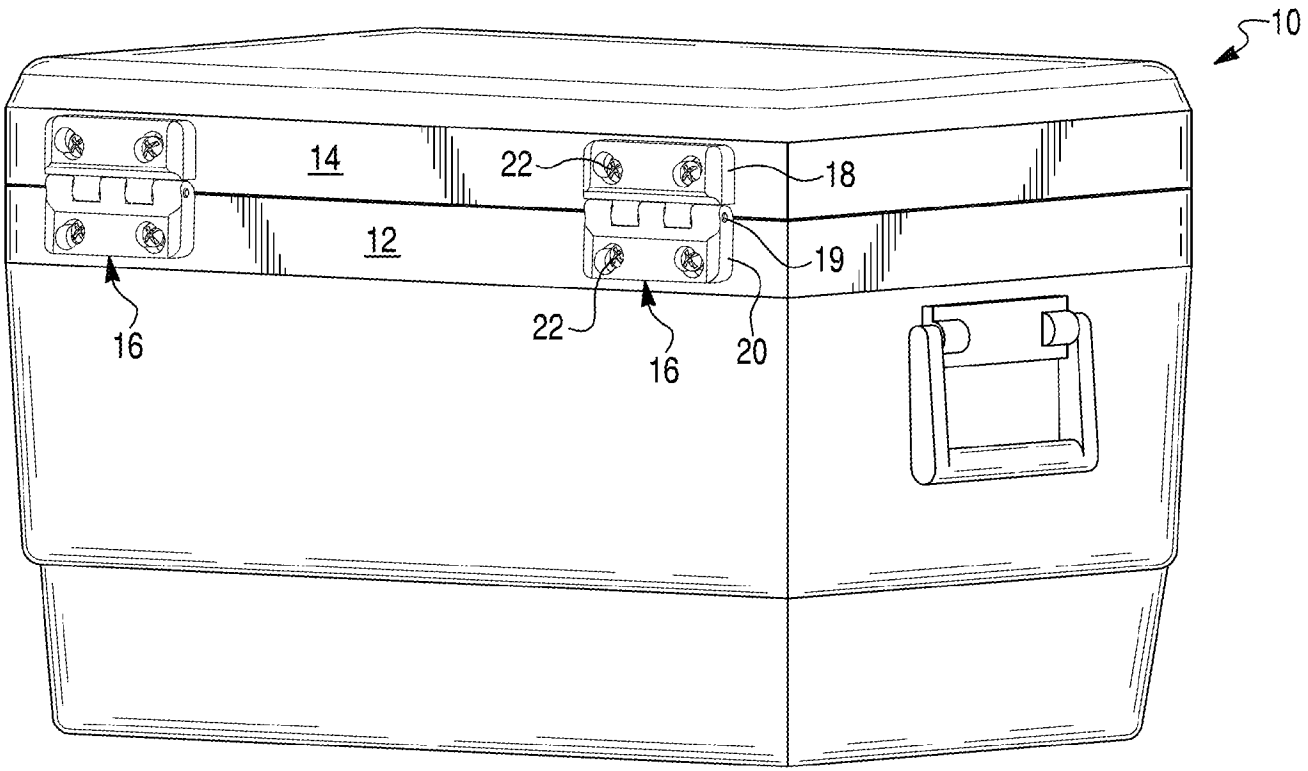
FIG. 1 is a perspective view of a container with a hinge assembly according to a first exemplary embodiment of the present invention.

Reference will now be made in detail to exemplary embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in connection with the exemplary embodiments and methods.

This description of exemplary embodiments is intended to be read in connection with the accompanying drawings, which are to be considered part of the entire written description. In the description, relative terms such as "horizontal," "vertical," "front," "rear," "upper", "lower", "top" and "bottom" as well as derivatives thereof (e.g., "horizontally," "downwardly," "upwardly," etc.) should be construed to refer to the orientation as then described or as shown in the drawing figure under discussion and to the orientation relative to a vehicle body. These relative terms are for convenience of description and normally are not intended to require a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. Additionally, the word "a" as used in the claims means "at least one".

Figure 5A:
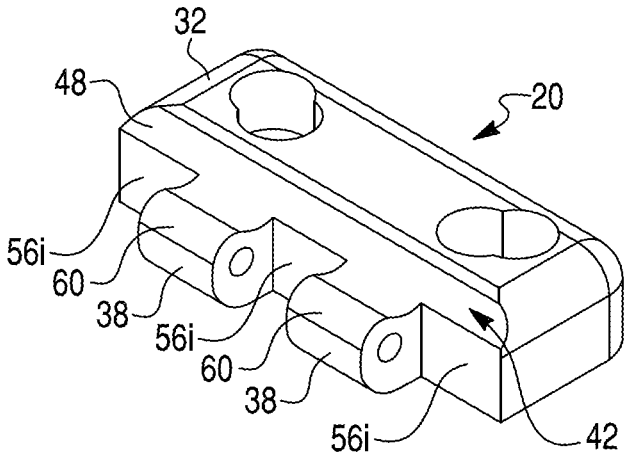
FIG. 5A is a perspective view of a second hinge half according to the first exemplary embodiment of the present invention.
Figure 5B:
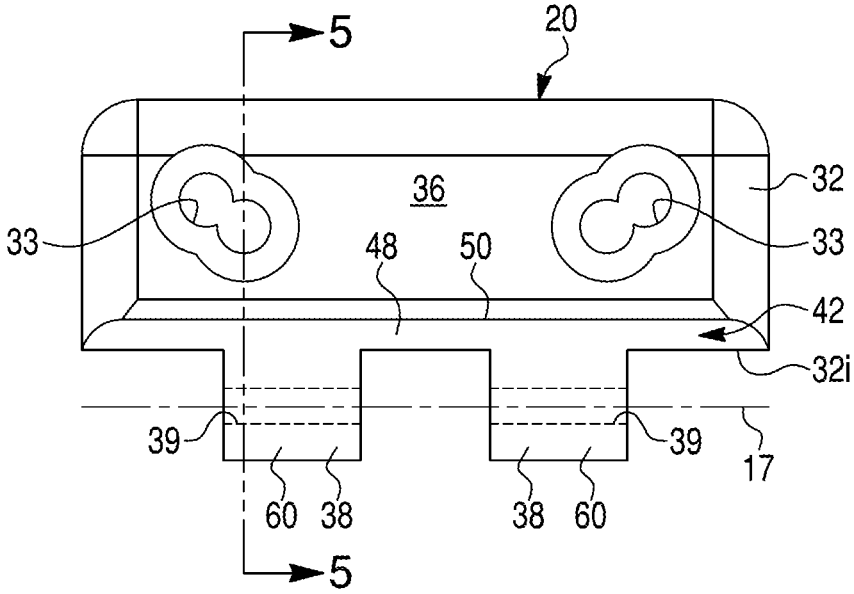
FIG. 5B is a top view of the second hinge half according to the first exemplary embodiment of the present invention.
Figure 5C:
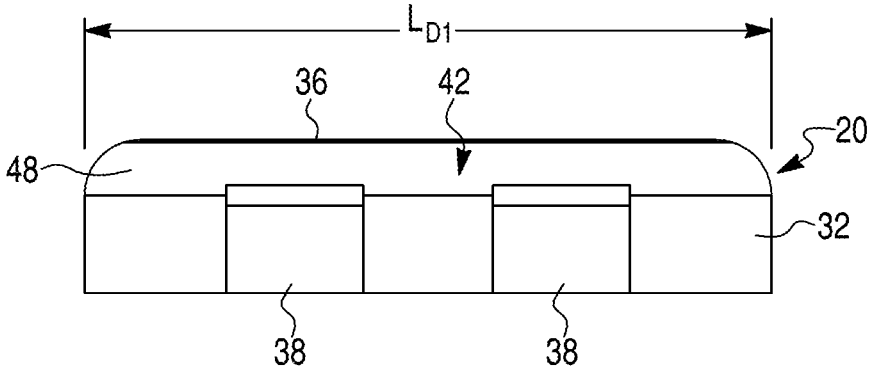
FIG. 5C is a front view of the second hinge half according to the first exemplary embodiment of the present invention.
Figure 5D:
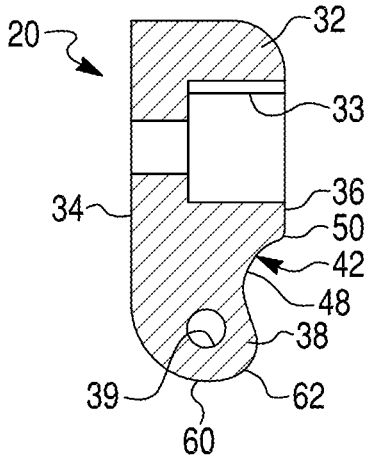
FIG. 5D is a cross-sectional view of the second hinge half according to the first exemplary embodiment of the present invention taken along the lines 5-5 in FIG. 5B.
Figure 6:
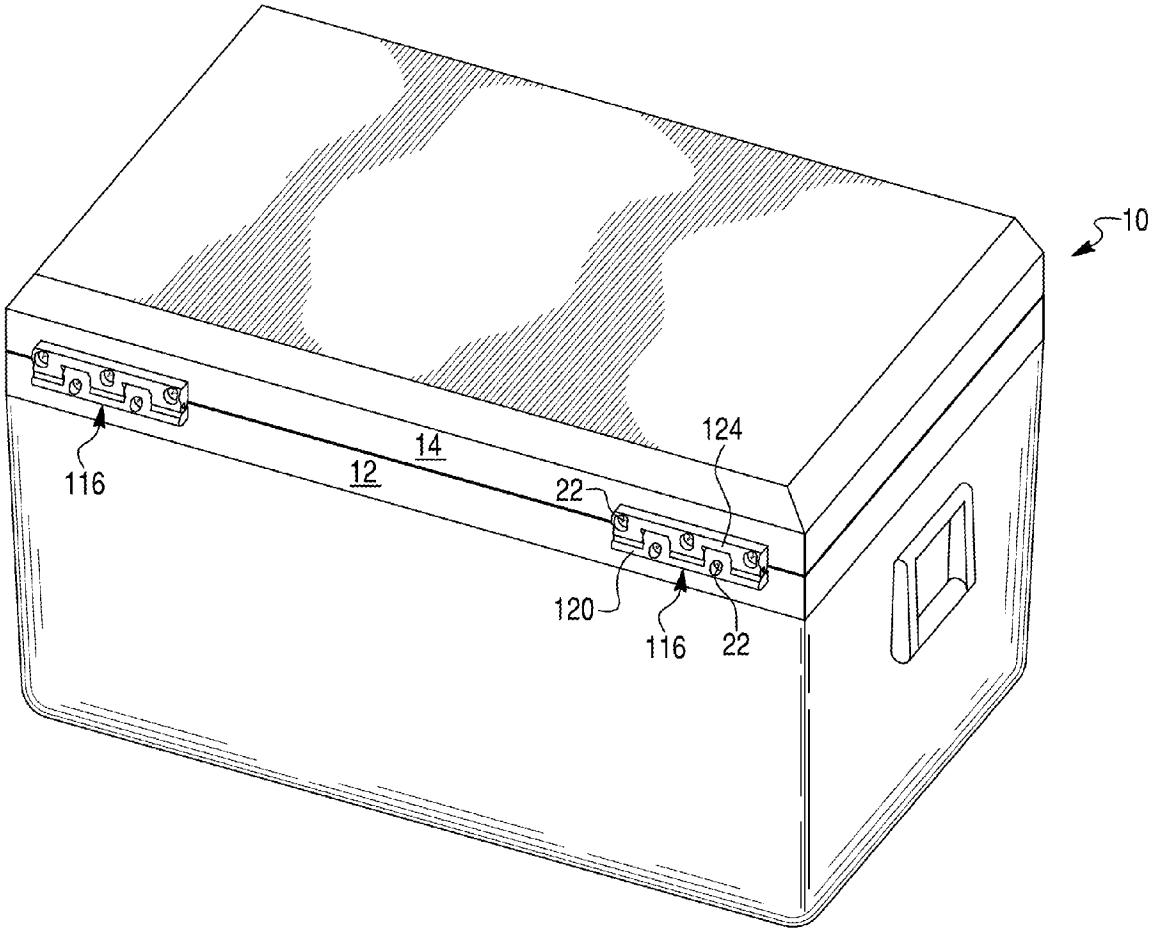
FIG. 6 is a perspective view of a container with a hinge assembly according to a second exemplary embodiment of the present invention

The present invention is related to an insulated container, such as a cooler for cold drinks or the like, generally denoted by reference numeral 10 (as shown in FIGS. 5 and 6). The container 10 preferably has relatively hard inner and outer plastic shells with suitable insulating material therebetween, such as polyurethane. The container 10 includes a box-like receptacle 12 and a lid 14 mounted thereon and pivotable between open and closed positions. At least two hinge assemblies extends between a rear edge of the receptacle 12 and a rear edge of the lid 14 for connecting the lid 14 to the receptacle 12 for pivotal movement.

FIGS. 1-3B of the drawings illustrate a hinge assembly 16 according to a first exemplary embodiment of the present invention. The hinge assemblies 16, according to the exemplary embodiments of the present invention, are identical. Each of the hinge assemblies 16 includes a pair of interfitting first (or upper) and second (or lower) hinge halves 18 and 20, respectively. Specifically, the first (or upper) hinge half 18 is fixedly secured to the lid 14, while the second (or lower) hinge half 20 is fixedly secured to the receptacle 12 of the container 10.

Figure 2B:
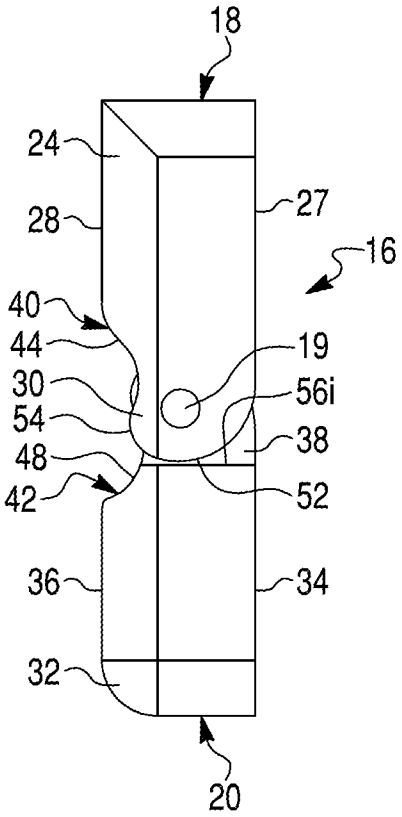
FIG. 2B is a side view of the hinge assembly according to the first exemplary embodiment of the present invention in the flattened position.
Figure 2A:
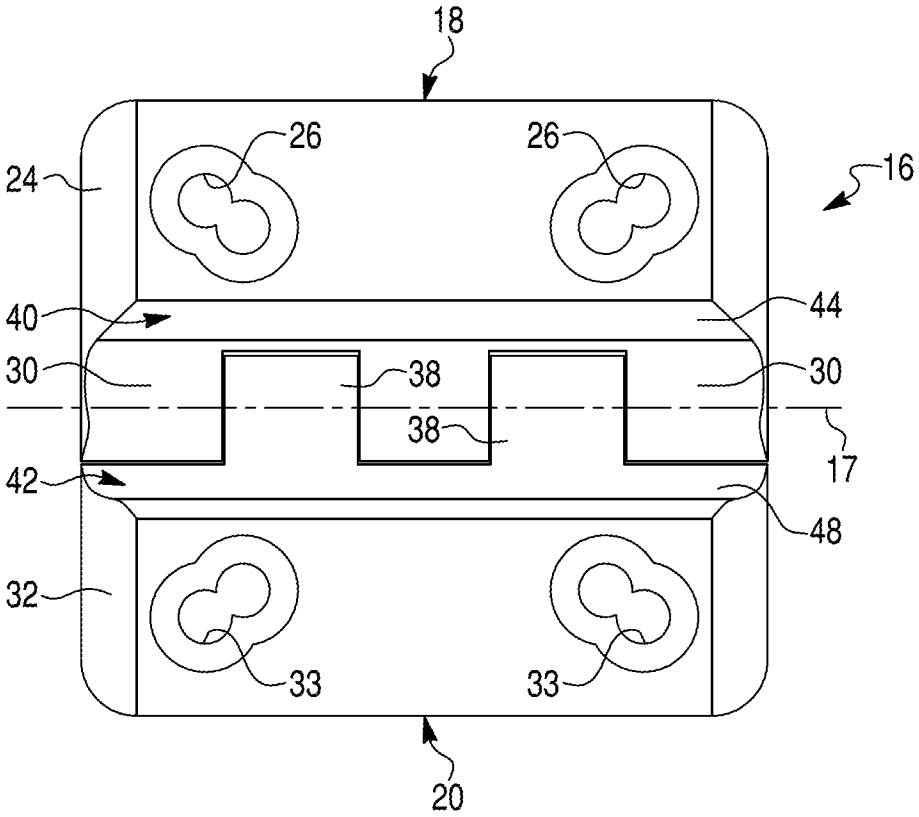
FIG. 2A is a top view of a hinge assembly according to the first exemplary embodiment of the present invention in a flattened position.
Figure 3B:
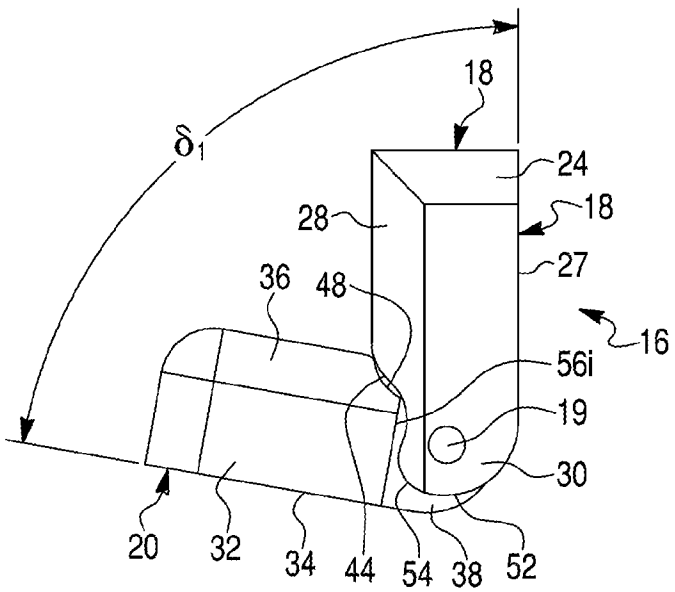
FIG. 3B is a side view of the hinge assembly according to the first exemplary embodiment of the present invention in the folded position.
Figure 3A:
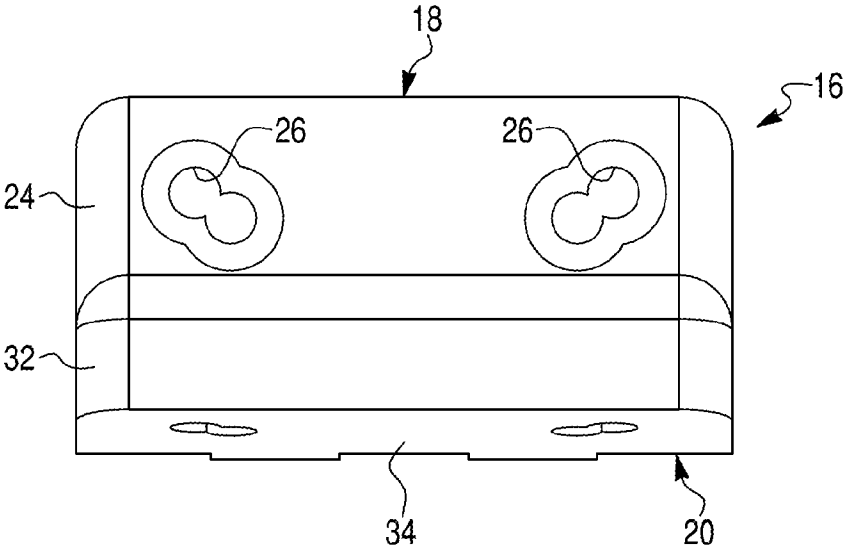
FIG. 3A is a top view of the hinge assembly according to the first exemplary embodiment of the present invention in a folded position.

The hinge halves 18 and 20 are pivotally connected to each other by a hinge pin 19 so as to be pivotable about a hinge axis 17 between a flattened position (as illustrated in FIGS. 2A and 2B) and a folded position (as illustrated in FIGS. 3A and 3B). In other words, the hinge halves 18 and 20 of the hinge assembly 16 are in the flattened position when the lid 14 of the container 10 is in the closed position (as illustrated in FIGS. 1, 2A and 2B). Similarly, the hinge halves 18 and 20 of the hinge assembly 16 are in the folded position when the lid 14 of the container 10 is in the open position. The hinge assembly 16 is secured by hinge screws 22 (best shown in FIG. 1) to the container 10. The hinge pin 19 is coaxial with the hinge axis 17.

The hinge halves 18 and 20 may be formed of a suitable molded, self-lubricating, non-corrosive plastic material, such as nylon, styrene, polypropylene, polycarbonate, or reinforced plastic, while the hinge pin 19 may be made of stainless steel. The hinge halves 18 and 20, according to exemplary embodiments of the present invention, are formed of the acetal plastic material, which is self-lubricating on the hinge pin made of the 304 stainless steel. The acetal plastic material is also food grade, non-corrosive and offers UV protection.

As best illustrated in FIGS. 2A-3B, the first hinge half 18 comprises a first hinge leaf 24 and a plurality of first hinge knuckles 30. The first hinge leaf 24 has a plurality of openings 26 extending therethrough for receiving the hinge screws 22 or other customary fasteners for attaching the first hinge half 18 to the lid 14. The hinge assemblies 16 are designed to replace factory installed hinges on containers, such as coolers, made by various manufacturers. Thus, in order to accommodate the containers of different models and/or made by various manufacturers, each of the openings 26 is in the form of a number "8" and comprises two circular holes each provided for receiving the hinge screws 22. The first hinge leaf 24 also has a planar inner surface 27 configured to engage the rear edge of the lid 14 and a substantially planar outer surface 28.

As further illustrated in FIGS. 2A-3B, the second hinge half 20 comprises a second hinge leaf 32 and a plurality of second hinge knuckles 38. The second hinge leaf 32 has a plurality of openings 33 extending therethrough for receiving the hinge screws 22 or other customary fasteners for attaching the second hinge half 20 to the receptacle 12. Similarly to the first hinge leaf 24, each of the openings 33 is in the form of a number "8" and comprises two circular holes each provided for receiving the hinge screws 22. The second hinge leaf 32 also has a planar inner surface 34 configured to engage the rear edge of the receptacle 12 and a substantially planar outer surface 36. The first and second hinge leaves 24 and 32, respectively, can be identical or different from each other.

The first hinge knuckles 30 are integrally molded with the first hinge leaf 24 so as to radially extend from an inner edge 24*i* of the first hinge leaf 24. Moreover, each of the first hinge knuckles 30 has a passage 31 therethrough coaxial with the hinge axis 17. Similarly, the second hinge knuckles 38 are integrally molded with the second hinge leaf 32 so as to radially extend from an inner edge 32*i* of the second hinge leaf 32. Each of the second hinge knuckles 38 has a passage 39 therethrough coaxial with the hinge axis 17 when assembled, as best shown in FIG. 2A. The relative terms such as "axially" and "radially" are with respect to orientations parallel to and perpendicular to the hinge axis 17, respectively.

As illustrated in FIGS. 2A, 3A, 4A, 4B, 5A and 5B, the first and second hinge knuckles 30 and 38, respectively, are axially spaced apart and, when assembled, inter-fit to provide a substantially continuous passageway for receiving the hinge pin 19. Although the first hinge half 18 is illustrated as comprising three first hinge knuckles 30 and the second hinge half 20 is illustrated as comprising two second hinge knuckles 38, it will be apparent that the number and placement of the hinge knuckles is subject to modification.

The first hinge leaf 24 of the first hinge half 18 is formed with a convex edge portion 40, while the second hinge leaf 32 of the second hinge half 20 includes a concave nesting depression 42.

Figure 4A:
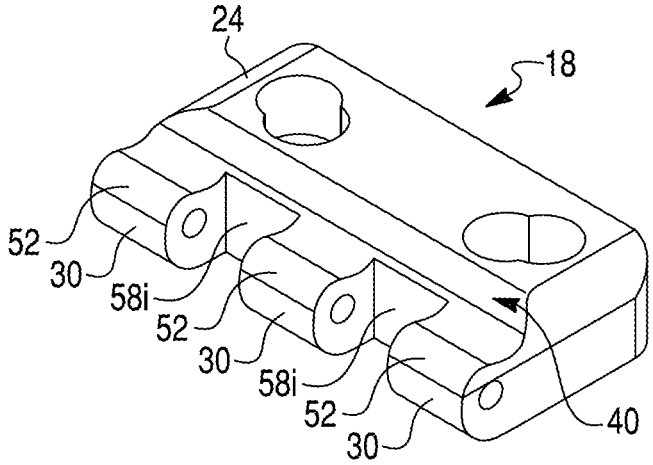
FIG. 4A is a perspective view of a first hinge half according to the first exemplary embodiment of the present invention.
Figure 4B:
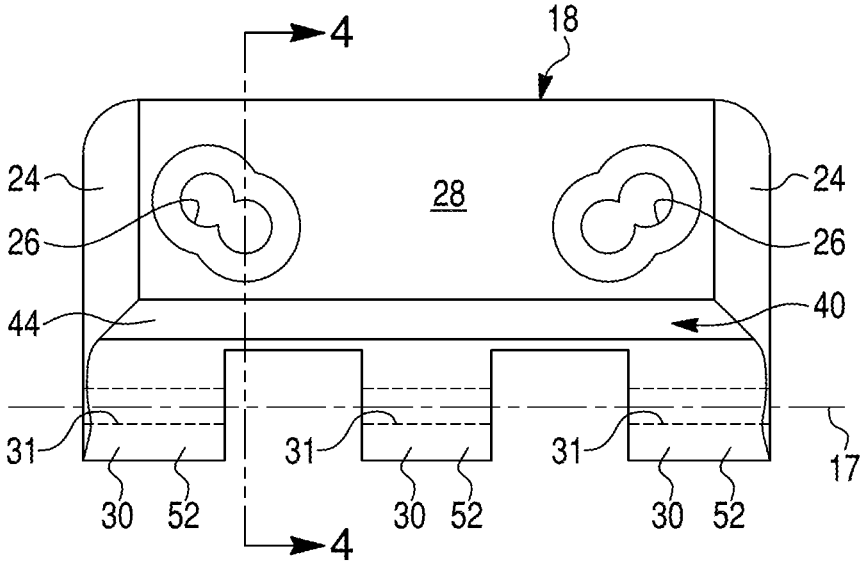
FIG. 4B is a top view of the first hinge half according to the first exemplary embodiment of the present invention.
Figure 4C:
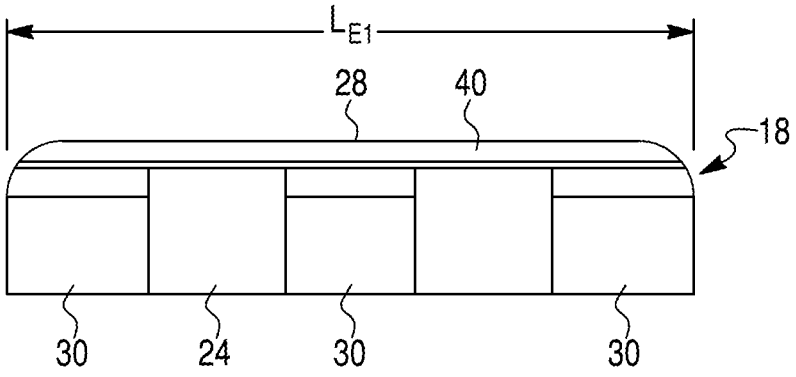
FIG. 4C is a front view of the first hinge half according to the first exemplary embodiment of the present invention.
Figure 4D:
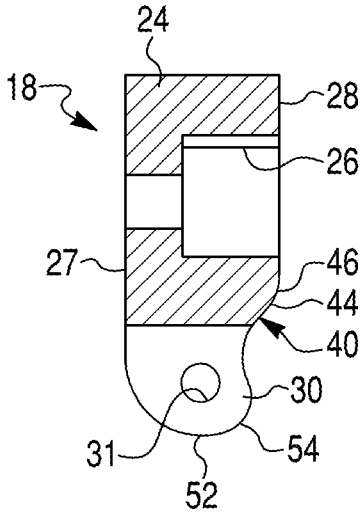
FIG. 4D is a cross-sectional view of the first hinge half according to the first exemplary embodiment of the present invention taken along the lines 4-4 in FIG. 4B.

The convex edge portion 40 has a convex surface 44 including a tip (or apex) 46 thereof. In the first exemplary embodiment of the present invention, the apex 46 continuously extends a full length $L_E$ of the convex surface 44 of the convex edge portion 40 and is oriented substantially parallel to the hinge axis 17. As shown in FIGS. 4B and 4D, the convex surface 44 of the edge portion 40 extends between the first hinge knuckles 30 and the outer surface 28 of the first hinge leaf 24.

In turn, the concave nesting depression 42 has a concave surface 48 extending a length $L_{D1}$ of the concave nesting depression 42 and is oriented substantially parallel to the hinge axis 17. As shown in FIGS. 5B and 5D, the concave surface 48 of the nesting depression 42 extends between the second hinge knuckles 38 and the outer surface 36 of the second hinge leaf 32. Specifically, the concave surface 48 extends between the inner edge 32*i* of the second hinge leaf 32 and an outer edge 50 of the nesting depression 42.

In operation, when the lid 14 of the container 10 is lifted and opened, and the hinge assembly 16 is pivotally moved from the flattened position to the folded position thereof, the convex surface 44 of the convex edge portion 40 of the upper hinge half 18 pivots and nestably engages the concave surface 48 of the nesting depression 42 of the lower hinge half 20 along a full length thereof, resulting in an extremely high strength due to full body nesting, positive stop, self-resting locating with a pre-determined angle δ of restraint.

Therefore, the nesting depression 42 of the lower hinge half 20 functions as a positive stop for the upper hinge half 18 of the hinge assembly 16. The resulting pre-determined angle δ creates an opening angle of the lid 14 that limits the pressure on the hinge screws 22. According to the exemplary embodiment of the present invention, the resulting pre-determined angle δ is 100°-110°.

Moreover, each of the first hinge knuckles 30 has an outer surface forming an eccentric cam surface 52 including at an apex 54. The apex 54 forms a high point of the cam surface 52, i.e., the point on the cam surface 52 farthest from the hinge axis 17. The distance between the hinge axis 17 and the cam surface 52 is less than the distance between the hinge axis 17 and an inner side surface 56*i* of the second hinge half 20 for the whole length of the cam surface 52 except the apex 54. In other words, the distance between the hinge axis 17 and the apex 54 of the first hinge knuckle 30 is more than the distance between the hinge axis 17 and an inner side surface 56*i* of the second hinge half 20.

Therefore, upon an upward swinging of the lid 14 from a closed horizontal position resulting from an upward force, the cam surfaces 52 of the first hinge knuckles 30 engage the inner side surface 56*i* of the second hinge half 20 at the apex 54 of the eccentric cam surface 52, which restrains the opening movement of the lid 14. In order for the lid 14 to be opened, sufficient opening force must be applied to the lid 14 so that t the apex 54 of the cam surface 52 slides over the inner side surface 56*i* of the second hinge half 20. The amount of opening force required may be predetermined by the amount of resilience formed in the inner side surface 56*i* and the amount of eccentricity of the apex 54.

Likewise, upon pivoting movement to the full open position shown in FIGS. 3A and 3B, the inner side surface 56*i* of the second hinge half 20 is past the apex 54 and the apex 54 resists pivoting movement of the lid 14 to a closed position. The amount of closing force required is likewise determined by the amount of resilience in the inner side surface 56*i* and the height or eccentricity of the apex 54 of the cam surface 52. The hinge assembly 16 of the present invention provides a snap-like latching action adjacent the fully opened and closed positions of the lid 14 with the apex 54 acting as a latch member against the adjacent inner side surface 56*i* of the second hinge half 20.

Similarly, each of the second hinge knuckles 38 has an outer surface forming an eccentric cam surface 60 including at an apex 62. The apex 62 forms a high point of the cam surface 60, i.e., the point on the cam surface 60 farthest from the hinge axis 17. The distance between the hinge axis 17 and the cam surface 60 is less than the distance between the hinge axis 17 and an inner side surface 58*i* of the first hinge half 18 for the whole length of the cam surface 60 except the apex 62. In other words, the distance between the hinge axis 17 and the apex 62 of the second hinge knuckle 38 is more than the distance between the hinge axis 17 and the inner side surface 58*i* of the first hinge half 18. The second hinge knuckles 38 functions similarly in conjunction with the inner side surface 58*i* of the first hinge half 18, as the first hinge knuckles 30 functions in conjunction with the inner side surface 56*i* of the second hinge half 20.

FIGS. 6-12D of the drawings illustrate a second exemplary embodiment of a hinge assembly, generally depicted by the reference character 116. In the interest of brevity, components, which are unchanged from the first exemplary embodiment of the present invention and are discussed above in connection with FIGS. 1-5D, are labeled with the same reference characters and are not further elaborated upon below, except to the extent necessary or useful to explain the additional embodiments of FIGS. 6-12D. Modified components and parts, which function in the same way as in the first exemplary embodiment of the present invention depicted in FIGS. 1-5D, are designated by the same reference numerals to some of which 100 has been added, sometimes without being described in detail since similarities between the corresponding parts in the two embodiments will be readily perceived by the reader.

Figure 7A:
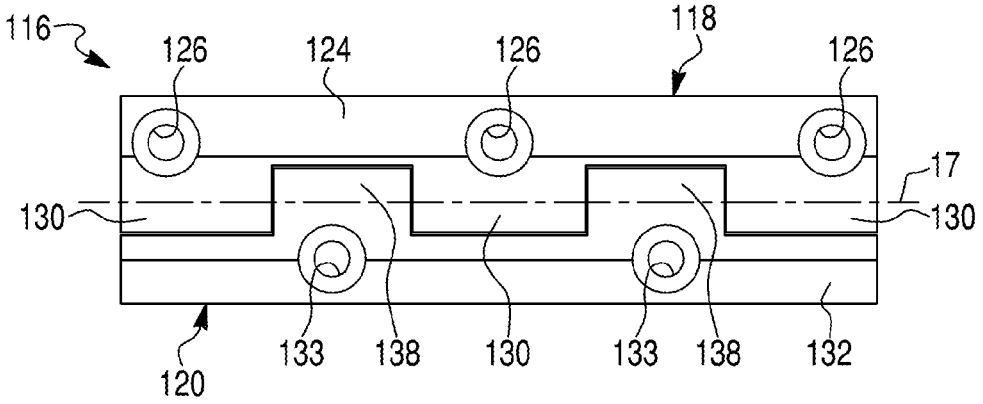
FIG. 7A is a top view of a hinge assembly according to the second exemplary embodiment of the present invention in a flattened position.
Figure 8A:
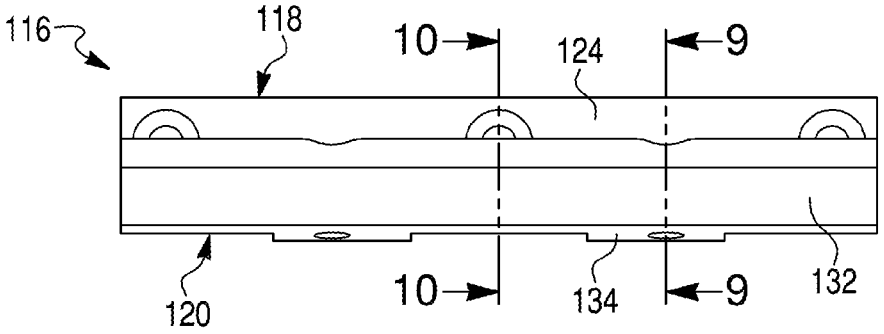
FIG. 8A is a top view of the hinge assembly according to the second exemplary embodiment of the present invention in a folded position.
Figure 7B:
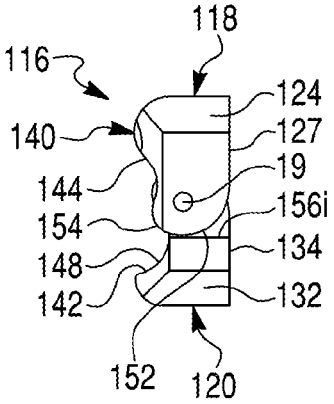
FIG. 7B is a side view of the hinge assembly according to the second exemplary embodiment of the present invention in the flattened position.
Figure 8B:
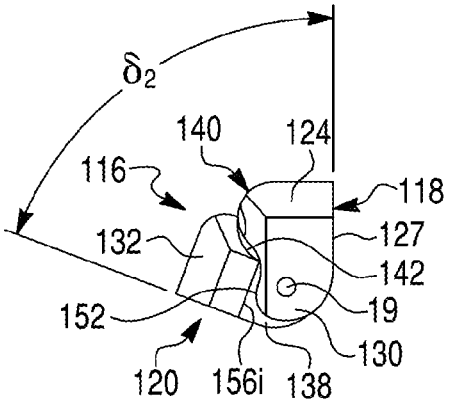
FIG. 8B is a side view of the hinge assembly according to the second exemplary embodiment of the present invention in the folded position.
Figure 9:
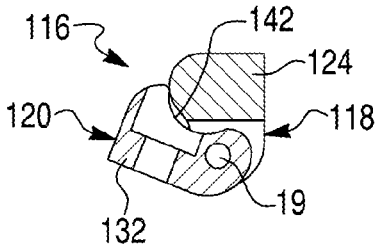
FIG. 9 is a cross-sectional view of the hinge assembly according to the second exemplary embodiment of the present invention taken along the lines 9-9 in FIG. 8A.
Figure 10:
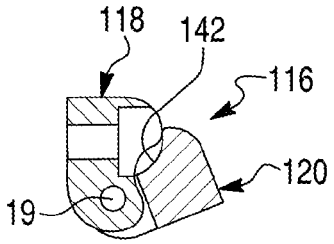
FIG. 10 is a cross-sectional view of the hinge assembly according to the second exemplary embodiment of the present invention taken along the lines 10-10 in FIG. 8A.

The hinge assemblies 116, according to the second exemplary embodiments of the present invention, are identical. Each of the hinge assemblies 116 includes a pair of interfitting first (or upper) and second (or lower) hinge halves 118 and 120, respectively. The hinge halves 118 and 120 are pivotally connected to each other by a hinge pin 19 and secured by hinge screws 22 to the container 10. The hinge halves 18 and 20 are pivotally connected to each other by the hinge pin 19 so as to be pivotable between a flattened position (as illustrated in FIGS. 7A and 7B) and a folded position (as illustrated in FIGS. 8A and 8B).

The hinge halves 118 and 120 may be formed of a suitable molded, self-lubricating, non-corrosive plastic material, such as nylon, styrene, polypropylene, polycarbonate, or reinforced plastic. The hinge halves 118 and 120, according to the second exemplary embodiments of the present invention, are formed of the acetal plastic material, which is self-lubricating on the hinge pin made of the 304 stainless steel. The acetal plastic material is also food grade, non-corrosive and offers UV protection.

As best illustrated in FIGS. 7A-8B and 11A-11B, the first hinge half 118 comprises a first hinge leaf 124 and a plurality of first hinge knuckles 130. The first hinge leaf 124 has a plurality of openings 126 extending therethrough for receiving the hinge screws 22 or other customary fasteners for attaching the first hinge half 118 to the lid 14. The hinge assemblies 116 are designed to replace factory installed hinges on containers, such as coolers, made by various manufacturers. The first hinge leaf 124 also has a planar inner surface 127 configured to engage the rear edge of the lid 14 and an outer surface 128.

As further illustrated in FIGS. 7A-8B and 12A-12B, the second hinge half 120 comprises a second hinge leaf 132 and a plurality of second hinge knuckles 138. The second hinge leaf 132 has a plurality of openings 133 extending therethrough for receiving the hinge screws 22 or other customary fasteners for attaching the second hinge half 120 to the receptacle 12. The second hinge leaf 132 also has a planar inner surface 134 configured to engage the rear edge of the receptacle 12 and an outer surface 136.

Figure 11A:
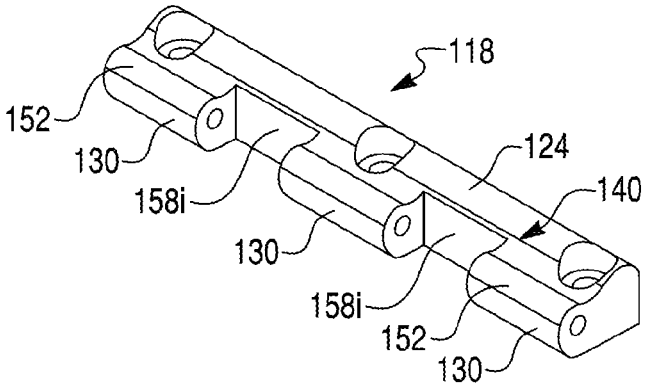
FIG. 11A is a perspective view of a first hinge half according to the second exemplary embodiment of the present invention.
Figure 11B:
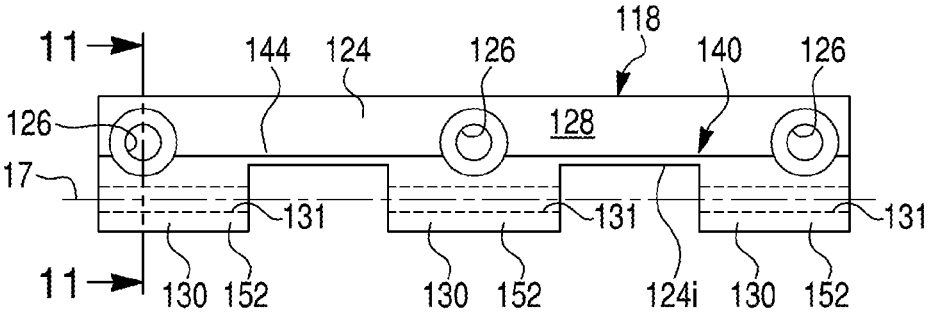
FIG. 11B is a top view of the first hinge half according to the second exemplary embodiment of the present invention.
Figure 11C:
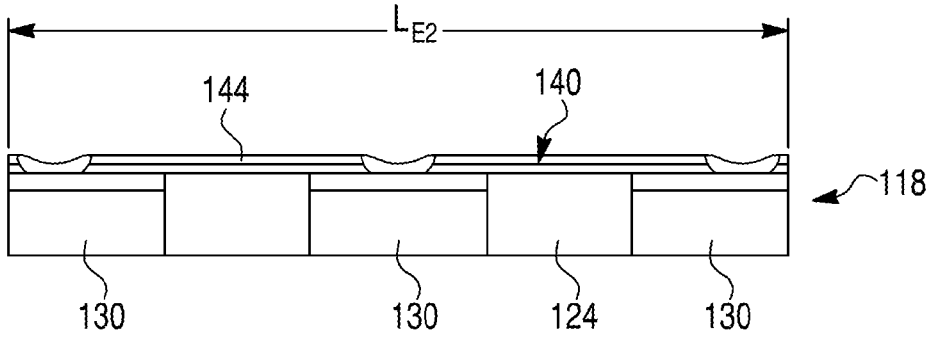
FIG. 11C is a front view of the first hinge half according to the second exemplary embodiment of the present invention.
Figure 11D:
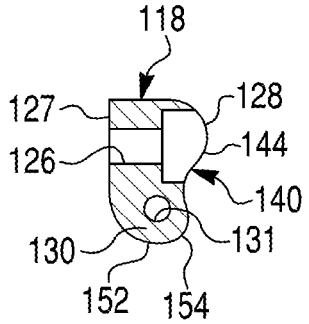
FIG. 11D is a cross-sectional view of the first hinge half according to the second exemplary embodiment of the present invention taken along the lines 13-13 in FIG. 5B.

The first hinge knuckles 130 are integrally molded with the first hinge leaf 124 so as to extend from an inner edge 124*i* of the first hinge leaf 24 (shown in FIG. 11B). Moreover, each of the first hinge knuckles 130 has a passage 131 therethrough defining a hinge axis 17. Similarly, the second hinge knuckles 138 are integrally molded with the second hinge leaf 132 so as to extend from an inner edge 132*i* of the second hinge leaf 132 (shown in FIG. 12B). Each of the second hinge knuckles 138 has a passage 139 therethrough coaxial with the hinge axis 17 when assembled, as best shown in FIG. 7A.

As illustrated in FIGS. 7A, 8A, 11A, 11B, 12A and 12B, the first and second hinge knuckles 130 and 138, respectively, are axially spaced apart and, when assembled, inter-fit to provide a substantially continuous passageway for receiving the hinge pin 19. Although the first hinge half 118 is illustrated as comprising three first hinge knuckles 130 and the second hinge half 120 is illustrated as comprising two second hinge knuckles 138, it will be apparent that the number and placement of the hinge knuckles is subject to modification.

The first hinge leaf 124 of the first hinge half 118 is formed with a convex edge portion 140, while the second hinge leaf 132 of the second hinge half 120 includes a concave nesting depression 142.

The convex edge portion 140 has a convex surface 144 including a tip (or apex) 146 thereof. In the first exemplary embodiment of the present invention, the apex 146 extends substantially a full length $L_{E2}$ of the convex surface 144 of the convex edge portion 140 and is oriented substantially parallel to the hinge axis 17.

Figure 12A:
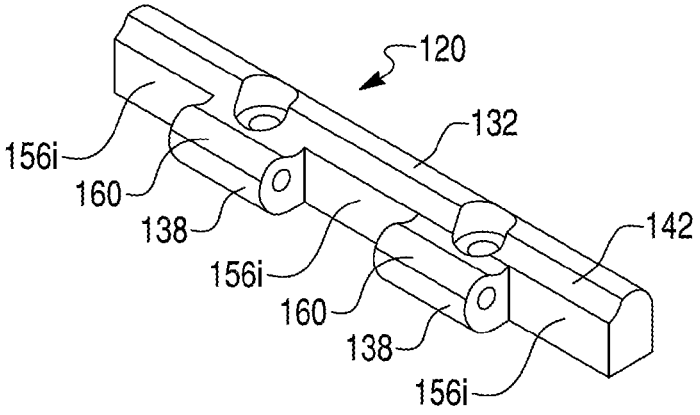
FIG. 12A is a perspective view of a second hinge half according to the second exemplary embodiment of the present invention.
Figure 12B:
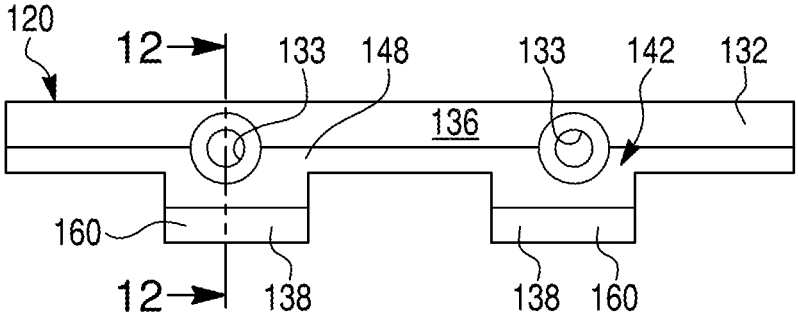
FIG. 12B is a top view of the second hinge half according to the second exemplary embodiment of the present invention.
Figure 12C:
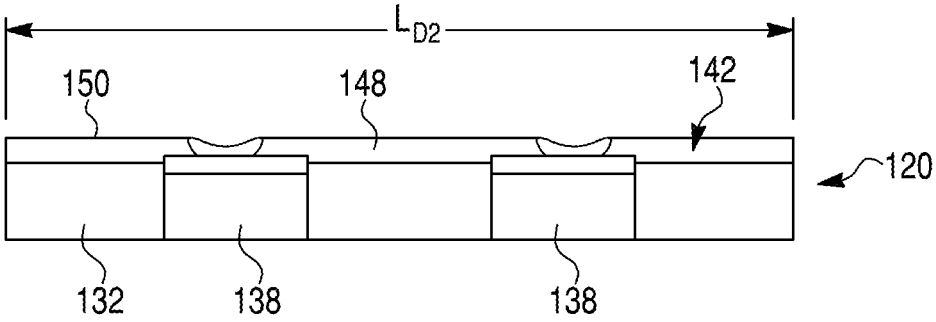
FIG. 12C is a front view of the second hinge half according to the second exemplary embodiment of the present invention.
Figure 12D:
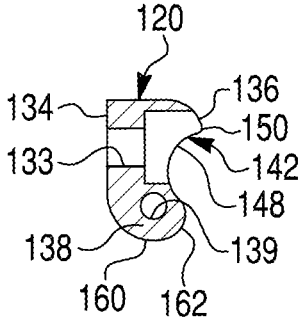
FIG. 12D is a cross-sectional view of the second hinge half according to the second exemplary embodiment of the present invention taken along the lines 14-14 in FIG. 14B.

In turn, the concave nesting depression 142 has a concave surface 148 extending a length $L_{D2}$ and is oriented substantially parallel to the hinge axis 17. As shown in FIGS. 12B and 12D, the concave surface 148 of the nesting depression 142 extends between the second hinge knuckles 138 and the outer surface 136 of the second hinge leaf 32. Specifically, the concave surface 148 extends between the inner edge 132*i* of the second hinge leaf 132 and an outer edge 150 of the nesting depression 142.

In operation, when the lid 14 of the container 10 is lifted and opened, and the hinge assembly 116 is pivotally moved from the flattened position to the folded position thereof, the convex surface 144 of the edge portion 140 of the upper hinge half 118 pivots and nestably engages the concave surface 148 of the nesting depression 142 of the lower hinge half 120 along a full length thereof, resulting in an extremely high strength due to full body nesting, positive stop, self-resting locating with a pre-determined angle δ of restraint.

Therefore, the nesting depression 142 of the lower hinge half 120 functions as a positive stop for the upper hinge half 118 of the hinge assembly 116. The resulting pre-determined angle δ creates an opening angle of the lid 114 that limits the pressure on the hinge screws 22. According to the second exemplary embodiment of the present invention, the resulting pre-determined angle $\delta_2$ is about 70°-80°.

Moreover, each of the first hinge knuckles 130 has an outer surface forming an eccentric cam surface 152 including at an apex 154. The apex 154 forms a high point of the cam surface 152, i.e., the point on the cam surface 152 farthest from the hinge axis 17. The distance between the hinge axis 17 and the cam surface 152 is less than the distance between the hinge axis 17 and an inner side surface 156*i* of the second hinge half 120 for the whole length of the cam surface 152 except the apex 154. In other words, the distance between the hinge axis 17 and the apex 154 of the first hinge knuckle 130 is more than the distance between the hinge axis 117 and an inner side surface 156*i* of the second hinge half 120.

Therefore, upon an upward swinging of the lid 14 from a closed horizontal position resulting from an upward force, the cam surfaces 152 of the first hinge knuckles 130 engage the inner side surface 156*i* of the second hinge half 20 at the apex 154 of the eccentric cam surface 152, which restrains the opening movement of the lid 14. In order for the lid 14 to be opened, sufficient opening force must be applied to the lid 14 so that t the apex 154 of the cam surface 152 slides over the inner side surface 156*i* of the second hinge half 120. The amount of opening force required may be predetermined by the amount of resilience formed in the inner side surface 156*i* and the amount of eccentricity of the apex 154.

Likewise, upon pivoting movement to the full open position shown in FIGS. 8A, 8B, 9 and 10, the inner side surface 156*i* of the second hinge half 120 is past the apex 154 and the apex 154 resists pivoting movement of the lid 14 to a closed position. The amount of closing force required is likewise determined by the amount of resilience in the inner side surface 156*i* and the height or eccentricity of the apex 154 of the cam surface 152. The hinge assembly 116 of the present invention provides a snap-like latching action adjacent the fully opened and closed positions of the lid 14 with the apex 154 acting as a latch member against the adjacent inner side surface 156*i* of the second hinge half 120.

Similarly, each of the second hinge knuckles 138 has an outer surface forming an eccentric cam surface 160 including at an apex 162. The apex 162 forms a high point of the cam surface 160, i.e., the point on the cam surface 160 farthest from the hinge axis 17. The distance between the hinge axis 17 and the cam surface 160 is less than the distance between the hinge axis 17 and an inner side surface 158*i* of the first hinge half 118 for the whole length of the cam surface 160 except the apex 162. In other words, the distance between the hinge axis 17 and the apex 162 of the second hinge knuckle 138 is more than the distance between the hinge axis 17 and the inner side surface 158*i* of the first hinge half 118. The second hinge knuckles 138 functions similarly in conjunction with the inner side surface 158*i* of the first hinge half 118, as the first hinge knuckles 130 functions in conjunction with the inner side surface 156*i* of the second hinge half 120.

The hinge assembly according to the exemplary embodiments of the present invention has the following advantages over the conventional practice in the art: high strength and full body nesting, positive stop, self resting, controlled motion, pre-determined angle restraint, self lubrication, UV protective acetal injection molded material, food grade, corrosion resistance.

The foregoing description of the exemplary embodiments of the present invention has been presented for the purpose of illustration in accordance with the provisions of the Patent Statutes. It is not intended to be exhaustive or to limit the invention to the precise forms disclosed. Obvious modifications or variations are possible in light of the above teachings. The embodiments disclosed hereinabove were chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. It is also intended that the scope of the present invention be defined by the claims appended thereto.

What is claimed is:

1. A hinge assembly for pivotally connecting a lid to a receptacle of a container, said hinge assembly comprising:

a first hinge half comprising a first hinge leaf and a first hinge knuckle extending from the first hinge leaf, said first hinge leaf comprising a first outer surface, a first inner edge past which said first hinge knuckle extends, and a convex edge portion having a convex surface extending between said first inner edge and said first outer surface; and a second hinge half comprising a second hinge leaf and a second hinge knuckle extending from said second hinge leaf and being pivotally connectable to said first hinge knuckle of said first hinge half for pivotable movement about a hinge axis between a flattened position and a folded position of said hinge assembly, said second hinge leaf comprising a second outer surface, a second inner edge past which said second hinge knuckle extends, and a concave nesting depression having a concave surface extending between said second inner edge and said second outer surface, said concave nesting depression of said second hinge leaf nestably engaging said convex edge portion of said first hinge leaf in said folded position of said hinge assembly.

2. The hinge assembly as defined in claim 1, further comprising a hinge pin coaxial with said hinge axis and pivotally connecting said first and second hinge halves to each other.

3. The hinge assembly as defined in claim 1, wherein said concave nesting depression nestably engages said convex edge portion of the first hinge half along a full length of said convex edge portion in said folded position of said hinge assembly.

4. The hinge assembly as defined in claim 1, wherein said convex surface has an apex; and wherein said apex of said convex surface nestably engages said concave surface in said folded position of said hinge assembly.

5. The hinge assembly as defined in claim 1, wherein said convex edge portion has an apex continuously extending a full length of said convex surface and oriented substantially parallel to said hinge axis; wherein said concave surface extends a full length of said concave nesting depression and is oriented substantially parallel to said hinge axis; and wherein said apex of said convex surface nestably engages said concave surface along said full length of said convex surface in said folded position of said hinge assembly.

6. The hinge assembly as defined in claim 1, wherein said first hinge knuckle comprises a plurality of first hinge knuckles, and said second knuckle comprises a plurality of second hinge knuckles inter-fitted with said first hinge knuckles.

7. The hinge assembly as defined in claim 6, further comprising a hinge pin coaxial with said hinge axis and pivotally connecting said first and second hinge halves to each other; wherein each of said first and second hinge knuckles has a passage therethrough coaxial with said hinge axis; and wherein said passages receiving said hinge pin therethrough.

8. The hinge assembly as defined in claim 6, wherein said convex edge portion is formed on said first hinge leaf; wherein said concave nesting depression is formed on said second hinge leaf; wherein said first and second hinge leaves are formed from a member selected from the group consisting of nylon, styrene, polypropylene, polycarbonate and reinforced plastic.

9. The hinge assembly as defined in claim 6, wherein said first hinge knuckles are formed integrally with said first hinge leaf; and wherein said second hinge knuckles are formed integrally with said second hinge leaf.

10. The hinge assembly as defined in claim 6, wherein said first hinge leaf has a plurality of first openings extending therethrough, and wherein said second hinge leaves has a plurality of second openings extending therethrough.

11. A container comprising:

a box-shaped receptacle;

a lid mounted on said box-shaped receptable and pivotable between open and closed positions; and a hinge assembly pivotally connecting said lid to said receptacle, said hinge assembly comprising a first hinge half fixedly secured to said lid and comprising a first hinge leaf and a first hinge knuckle extending from said first hinge leaf, said first hinge leaf comprising a first outer surface, a first inner edge past which said first hinge knuckle extends, and a convex edge portion having a convex surface extending between said first inner edge and said first outer surface; and a second hinge half fixedly secured to said receptacle and comprising a second hinge leaf and a second hinge knuckle extending from said second hinge leaf, said second hinge knuckle being pivotally connected to said first hinge knuckle of said first hinge half for pivotable movement about a hinge axis between a flattened position and a folded position of said hinge assembly, said second hinge leaf comprising a second outer surface, a second inner edge past which said second hinge knuckle extends, and a concave nesting depression having a concave surface extending between said second inner edge and said second outer surface, said concave nesting depression of said second hinge leaf nestably engaging said convex edge portion of said first hinge leaf in said folded position of said hinge assembly.

12. The container as defined in claim 11, wherein said hinge assembly further comprises a hinge pin coaxial with said hinge axis and pivotally connecting said first and second hinge halves to each other.

13. The container as defined in claim 11, wherein said concave nesting depression nestably engages said convex edge portion of said first hinge leaf along a full length of said convex edge portion in said folded position of said hinge assembly.

14. The container as defined in claim 11, wherein said convex surface has an apex; and wherein said apex of said concave surface nestably engages said concave surface in said folded position of said hinge assembly.

15. The container as defined in claim 11, wherein said convex surface has an apex continuously extending a full length of said convex surface and oriented substantially parallel to said hinge axis; wherein said concave surface extends a full length of said concave nesting depression and is oriented substantially parallel to said hinge axis; and wherein said apex of said convex surface nestably engages said concave surface along said full length of said convex surface in said folded position of said hinge assembly.

16. The container as defined in claim 11, wherein said first hinge knuckles comprises a plurality of first hinge knuckles, and said second hinge knuckle comprises a plurality of second hinge knuckles inter-fitted with said first hinge knuckles.

17. The container as defined in claim 16, further comprising a hinge pin coaxial with said hinge axis and pivotally connecting said first and second hinge halves to each other; wherein each of said first and second hinge knuckles has a passage therethrough coaxial with said hinge axis; and wherein said passages receiving said hinge pin therethrough.

18. The hinge assembly as defined in claim 16, wherein said convex edge portion is formed on said first hinge leaf; wherein said concave nesting depression is formed on said second hinge leaf; and wherein said first and second hinge leaves are formed from a member selected from the group consisting of nylon, styrene, polypropylene, polycarbonate and reinforced plastic.

19. The container as defined in claim 16, wherein said first hinge knuckles are formed integrally with said first hinge leaf; and wherein said second hinge knuckles are formed integrally with said second hinge leaf.

20. The container as defined in claim 16, wherein said first hinge leaf has a plurality of first openings extending therethrough for receiving hinge fasteners for attaching said first hinge half to said receptacle; and wherein said second hinge leaf has a plurality of second openings extending therethrough for receiving hinge fasteners for attaching said second hinge half to said lid.

* * * * *